US009745727B2

(12) United States Patent
Gálan Benzal et al.

(10) Patent No.: US 9,745,727 B2
(45) Date of Patent: Aug. 29, 2017

(54) SYSTEM AND METHOD FOR CONTROLLING STABILITY IN HEAVY MACHINERY

(71) Applicant: EMPRESA DE TRANSFORMACIÓN AGRARIA, S.A. (TRAGSA, Madrid (ES)

(72) Inventors: Luis Antonio Gálan Benzal, Madrid (ES); Miguel Jesús Martín Moya, Huelva (ES); Juan Manuel Ayllón Guerola, Seville (ES); Rodrigo Calero Gil, Sevilla (ES); Julio Molano Sánchez, Sevilla (ES); Jaime Domíguez Abascal, Sevilla (ES); Salvador Malpartida Corrales, Sevilla (ES); Ignacio Manuel Sedeño, Sevilla (ES); Manuel López Hernández, Madrid (ES); Inmaculada Concepción, Sevilla (ES)

(73) Assignee: EMPRESA DE TRANSFOMACION AGRARIA S.A. (TRAGSA), Madrid (ES)

( * ) Notice: Subject to any disclaimer, the term of this patent is extended or adjusted under 35 U.S.C. 154(b) by 0 days.

(21) Appl. No.: 15/035,103

(22) PCT Filed: Nov. 13, 2014

(86) PCT No.: PCT/ES2014/070840

§ 371 (c)(1),
(2) Date: May 6, 2016

(87) PCT Pub. No.: WO2015/071520

PCT Pub. Date: May 21, 2015

(65) Prior Publication Data

US 2016/0281335 A1 Sep. 29, 2016

(30) Foreign Application Priority Data

Nov. 14, 2013 (ES) ..... 201331660

(51) Int. Cl.
*E02F 9/26* (2006.01)
*E02F 9/24* (2006.01)
(Continued)

(52) U.S. Cl.
CPC ..... *E02F 9/267* (2013.01); *E02F 3/32* (2013.01); *E02F 9/123* (2013.01); *E02F 9/24* (2013.01); *E02F 9/264* (2013.01)

(58) Field of Classification Search
CPC ..... E02F 3/32; E02F 9/123; E02F 9/24; E02F 9/264; E02F 9/267
(Continued)

(56) References Cited

U.S. PATENT DOCUMENTS 4,284,987 A * 8/1981 Gibson ..... B60R 16/0233 116/DIG. 13
5,160,055 A * 11/1992 Gray ..... B66C 23/90 212/278
(Continued)

FOREIGN PATENT DOCUMENTS

EP 2578757 4/2013
ES 2492404 8/2012
(Continued)

OTHER PUBLICATIONS

PCT/ES2014/070840 Search Report mailed Jul. 1, 2015, 2 pages—English, 3 pages—Spanish.
(Continued)

*Primary Examiner* — Tyler J Lee
(74) *Attorney, Agent, or Firm* — Andrew F. Young, Esq.; Lackenbach Siegel, LLP

(57) ABSTRACT

A system for controlling stability in heavy machinery of the type including chains or treads, based on risk of rollover associated with the working position thereof, having multiple detectors measuring the reaction value at the support points of the machine on the ground, determination in each instant of a support base defined by the actual supports of the machine. A calculation algorithm for calculating the risk of rollover taking into consideration the moments of rollover associated with each side of the support base. Furthermore, the system includes calculating a reversible rollover condition where an index of the risk of rollover which is a proportionality function associated with the position of the center of gravity of the machine with respect to the limits of the reversible rollover area is defined.

4 Claims, 7 Drawing Sheets

(51) Int. Cl.
*E02F 3/32* (2006.01)
*E02F 9/12* (2006.01)

(58) Field of Classification Search
USPC ..... 701/33.9, 50
See application file for complete search history.

(56) References Cited

U.S. PATENT DOCUMENTS

| | | | | |
|---|---|---|---|---|
| 6,991,119 | B2 * | 1/2006 | Puszkiewicz | E02F 9/24 212/261 |
| 8,768,581 | B2 * | 7/2014 | Mizuochi | B66C 23/905 701/124 |
| 9,399,382 | B2 * | 7/2016 | Benevelli | B60G 17/0155 |
| 2009/0112409 | A1 * | 4/2009 | Tollenaar | B66F 9/07559 701/50 |
| 2015/0217619 | A1 * | 8/2015 | Benevelli | B60G 17/0155 280/124.106 |

FOREIGN PATENT DOCUMENTS

| | | |
|---|---|---|
| WO | WO 2008/105997 | 9/2008 |
| WO | WO2012169531 | 12/2012 |

OTHER PUBLICATIONS

PCT/ES2014/070840 Written Opinion mailed Dec. 19, 2014. 7 pages—Spanish; 6 pages—English.

* cited by examiner

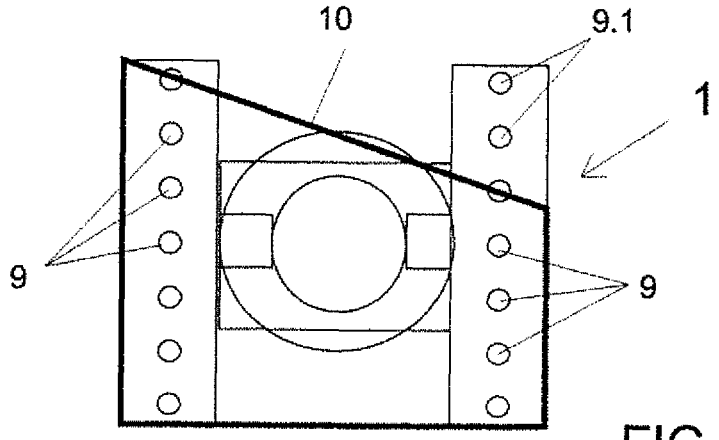
FIG. 2.1
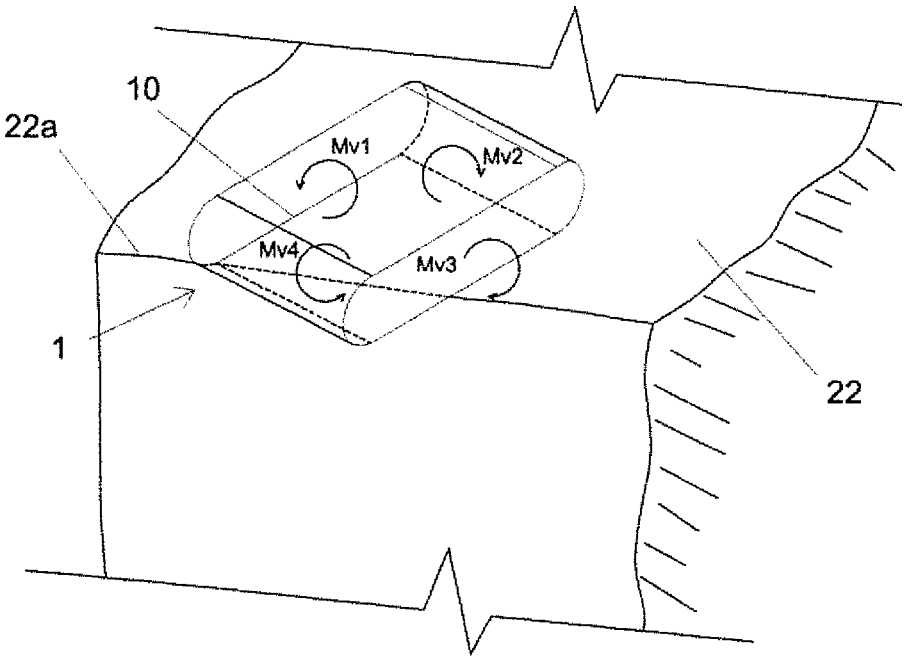
FIG. 2.2

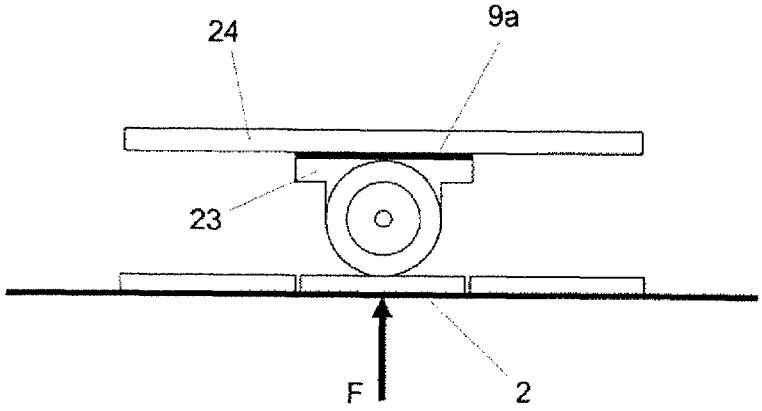
FIG. 3.1
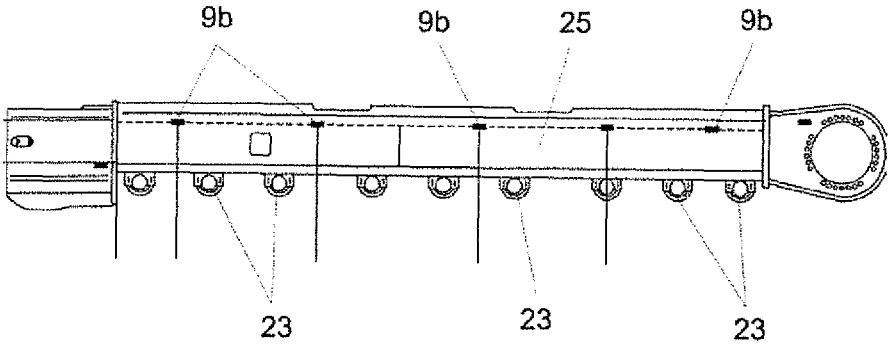
FIG. 3.2

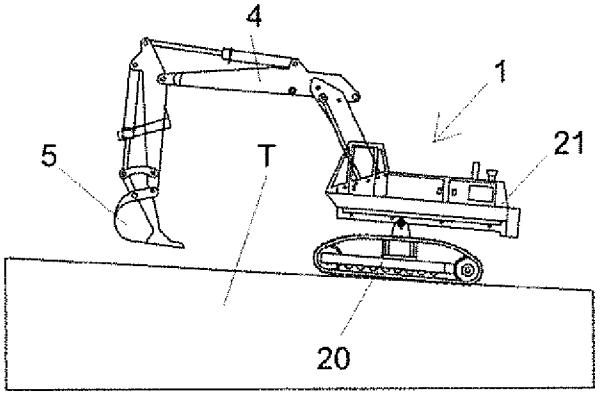
FIG. 6.1
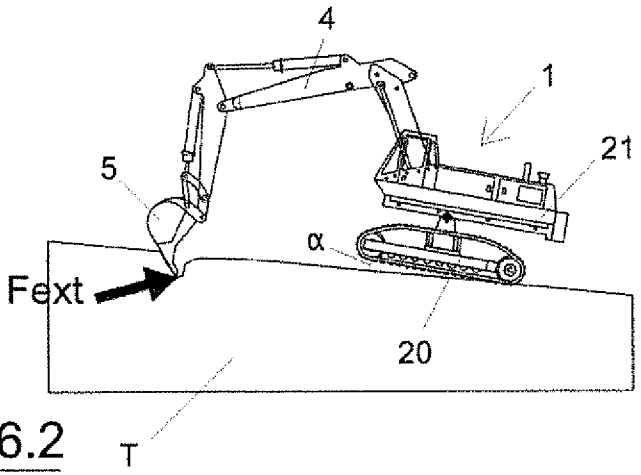
FIG. 6.2
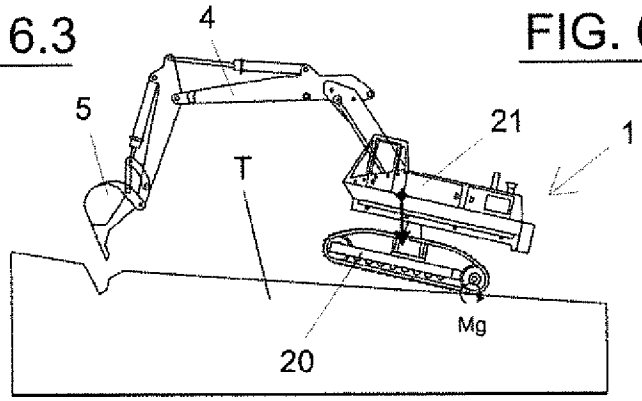
FIG. 6.3
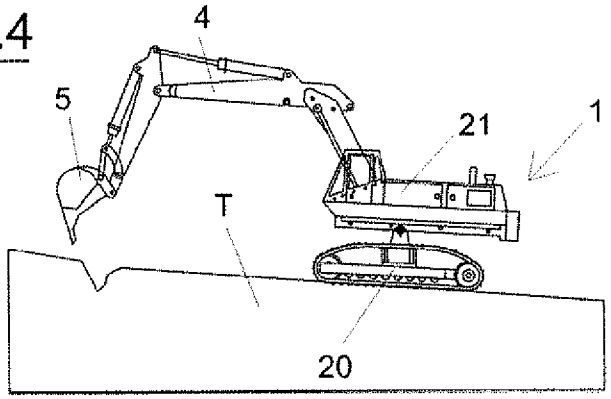
FIG. 6.4

SYSTEM AND METHOD FOR CONTROLLING STABILITY IN HEAVY MACHINERY

CROSS REFERENCE TO RELATED APPLICATIONS

This application relates to and claims priority from PCT Ser. No.: PCT/ES2014/070840 filed Nov. 13, 2014, the entire contents of which are incorporated by reference, which in turn claims priority from ES Ser. No. P201331660 filed Nov. 14, 2013.

FIGURE SELECTED FOR PUBLICATION

FIG. 1

BACKGROUND OF THE INVENTION

Field of the Invention

The present invention relates to a system for controlling stability in heavy machinery, providing essential features of novelty and significant advantages with respect to means that are known and used for the same purposes in the current state of the art.

More particularly, the invention relates to a system for controlling stability particularly applicable to heavy machinery, particularly to machines of the type including chains or treads for movement thereof, the operation of the system being based on knowing in each instant the reaction value at the support points of the machine on the ground, based on which the moments of rollover of the machine with respect to a closed polygonal enclosure provided by the actual support points of the machine on the support surface will be determined, as well as the determination of the rollover reversibility characteristic based on analyzing the value of the moment generated by the gravitational forces acting on the system around one of the sides of the closed polygonal enclosure on which the machine is supported. The field of application of the invention is comprised in the industrial sector dedicated to the development and installation of static and dynamic security systems in heavy machinery, particularly machines for public works and the like that are moved with chains or treads.

Description of the Related Art

A wide variety of devices and methods are known in the current state of the art intended for determining the risk of rollover of a machine or a vehicle of any type during the normal use thereof both in static and dynamic conditions, either as a result of the use made of same or as a result of other effects derived from or induced by situations not related to the vehicle itself (for example, traffic accidents or the like). In most devices and/or methods of the current state of the art, determination of a possible rollover situation is performed by means of using several sensors which are generally tilt sensors located in several positions of the vehicle, detecting and measuring parameters related to the verticality conditions of certain members of the vehicle, and generating signals which are processed and compared with pre-established threshold values considered as acceptable limits for assuring vehicle safety. Normally, the mentioned parameters are obtained based on measuring angles related to the rolling and/or tilt of the vehicle, such that when these angles of rolling and/or tilt exceed such pre-established thresholds, situation of risk of rollover is considered and a plurality of reactions is generated ranging from a simple alarm that warns the user or the control means about the occurring situation by means of light and/or sound signals, to the activation of other safety elements for counteracting the possible rollover situation, such as for example, activation of the front and/or rear brakes of the mover, subsequent reduction of the travel speed, correction of the angles of rotation, extension and deployment of safety means incorporated in the vehicle itself, etc.

However, for machines that perform field works (for example, backhoes intended for soil conditioning functions, agricultural machines, etc.), situations still arise in practice which, albeit generating machine positions that in most cases can lead to tilts exceeding those angles previously considered as operative limits or thresholds, do not however generate an actual risk of rollover. The case of a backhoe-type machine performing soil conditioning works can be mentioned, for example, which as a result of the effort made with the bucket when trying to drive it into the soil, can lead to a reaction causing the machine to be lifted partially with respect to the support edge of the chassis of the machine occupying a position opposite the arm bearing the work bucket, which together with the actual tilt the machine can already be subjected to due to the slopes of the soil surface itself in which it is supported, entails the adoption of a tilt angle surpassing the limits of the pre-established threshold, generating warnings of danger which do not actually constitute an actual risk of rollover, and which however make stopping the function being performed at that moment necessary. All this constitutes drawbacks generating delays, time losses, and increased production costs.

As an illustrative example of rollover prevention systems known and used today in relation to machinery of the mentioned type, the inventors of the system described in the present invention are aware of the existence in the state of the art of some prior art documents that will be described briefly below. Patent document WO 2008/105997 (Caterpillar Inc.) describes an automated rollover prevention system applicable to heavy machinery, intended for controlling the machine remotely and autonomously, in which one or more tilt sensors and/or sensors of other magnitudes is used with which signals indicative of the tilt of the machine are generated such that a controller device can determine stopping of the operation thereof when the tilt of the machine exceeds certain threshold levels, as well as the backward movement of the machine until the known final stable position.

European patent document EP-2492404 A1 (Hitachi Construction Machinery Co., Ltd.) describes a machine particularly useful in construction works, demolition works, civil engineering works and the like, in which it aims to provide stability to the machine at all times by solving the problem associated with the inertia forces derived from the up and down movement with respect to the chassis of the machine, of the mechanism of a front working fitting, or of the movement of the machine itself, evaluating in each instant the stability of the machine and communicating the results of that evaluation to an operator without delays. For such purpose, the machine includes: (i) Zero Moment Point (identified as ZMP) calculating means, using to that end position vectors, acceleration vectors and external force vectors at the respective mass points constituting the main chassis, including the front working mechanism and the undercarriage, and (ii) stability calculating means provided for defining a support polygon joining support points of the work machine with a ground and such that when the ZMP is included in a warning area formed inside a perimeter of the support polygon, producing a rollover warning. The support polygons referred to in patent document EP-2492404 A1 are depicted in FIGS. 5, 7, 8, 9(*a*), 9(*b*), 9(*c*), 9(*d*), 17(*a*), 17(*b*) and 17(*c*), the support polygons on which the risk regions are determined are depicted in FIGS. 4(*a*), 4(*b*), 6(*a*) and 6(*b*). However, in all the described examples, the support polygon is determined by the geometry defined by the way the machine is supported (chains, wheels or stabilizers), without the actual contrast of detector elements allowing precise determination in each instant of the actual support points of the machine on the ground. For this reason, European patent document EP-2492404 A1 (Hitachi Construction Machinery Co., Ltd.) is not applicable on concave support surfaces as described explicitly in line 38 of page 3 of said patent.

Furthermore, experience proves that when working with this type of machines, other situations that are not contemplated in patent document EP-2492404 A1 arise, such as for example, the fact that the machine is not completely supported on the ground, i.e., a part of the machine works on an incomplete surface, with a cantilevered portion, in which case the support polygon cannot be determined by the geometry defined by the way the machine is supported (chains, wheels or stabilizers), the latter being a clearly unstable situation which can entail certain risk of rollover and which the document under consideration does not solve.

European patent document EP-2578757 (Hitachi Construction Machinery Co., Ltd.) having features similar to the document mentioned above, describes a work machine safety system also having the purpose of achieving machine stability based on calculating the coordinates of a ZMP (Zero Moment Point) using to that end information about position, acceleration and external forces acting on the movable portions of the main body of the machine, including the front working mechanism and the undercarriage, incorporating calculating means for determining a polygon going through the theoretical contact points of the machine with the ground, and such that when the ZMP moves through the inside of the enclosure demarcated by said polygon, a rollover warning is produced when ZMP enters a predetermined warning region formed in the lower portion of the polygon. The system envisages the incorporation of means for graphically presenting and displaying the position of the ZMP inside the enclosure, included the warning region, and develops positional calculation algorithms of the ZMP, with predictive capacity with respect to the behavior of said point, and with means for storing information. The system does not describe or suggest a solution for the case in which the machine is not completely supported on the ground, but rather in a partially cantilevered manner with the risks that it entails or for the case in which the support surface is concave.

ASPECTS AND SUMMARY OF THE INVENTION

Compared to the prior art documents mentioned above, the present invention provides a novel and innovative system with which the drawbacks of the current systems are solved in a favorable manner as it allows a permanent, continuous and instantaneous real time analysis of the operative conditions associated with a backhoe-type machine or the like, which can move by means of chains or treads, with the advantageous particularity that the mentioned permanent analysis of the operative conditions of the machine is performed based on the actual instantaneous shape of the support enclosure of the machine and on the knowledge about reaction distribution on said support enclosure; which allows knowing at all times the stability of the machine without having to know the value of external forces (static or dynamic) operating thereon.

Therefore, an object of the present invention consists of providing a system which is specifically intended for instantaneously measuring the reaction value at the support points of the machine on the ground (as a result of the weight thereof and of the forces acting thereon, including inertia forces), and for analyzing in real time the stability of the machine against rollover by means of the instantaneous analysis of the moment of rollover in relation to each of the sides of a support base, calculated instantaneously and continuously, which support base is demarcated by a perimeter obtained from the actual supports which the machine has on the surface of travel, generally the ground surface, at that moment. This object furthermore includes a reversible rollover analysis (a situation that occurs when the machine drives the bucket into the ground) based on calculating the value of the moment generated by the gravitational forces acting on the system around the side of the closed polygonal enclosure furthest from the bucket on which the machine is supported.

Another object of the invention consists of providing means enabled for developing a calculation process for calculating the risk of rollover of the machine based on a calculation algorithm specifically taking into account the surface changes experienced in real time by the support base of the machine, together with the reactions acting on the supports of the machine, the balance situations of the machine and the reversible rollover situations.

The system of the present invention is applicable both to machines manually controlled by an operator and to machines remotely operated without an operator.

The above and other aspects, features and advantages of the present invention will become apparent from the following description read in conjunction with the accompanying drawings, in which like reference numerals designate the same elements.

BRIEF DESCRIPTION OF THE DRAWINGS

The foregoing and other features and advantages of the invention will be more clearly understood on the basis of the following detailed description of a preferred embodiment thereof, provided only by way of illustrative and non-limiting example in reference to the accompanying drawings, in which:

FIGS. 2.1 and 2.2 are drawings illustrating an example of an operative situation in relation to a possible perimeter of a support base of the machine and with the moments of rollover derived from that same operative situation, where a portion of the machine is arranged in cantilevered manner;

FIGS. 3.1 and 3.2 graphically show examples for positioning sensors intended for determining in real time the perimeter demarcating the support base of the machine in each instant according to the invention;

FIGS. 6.1, 6.2, 6.3 and 6.4 show a practical example of a reversible rollover sequence, and;

DETAILED DESCRIPTION OF THE PREFERRED EMBODIMENTS

Figure 1:
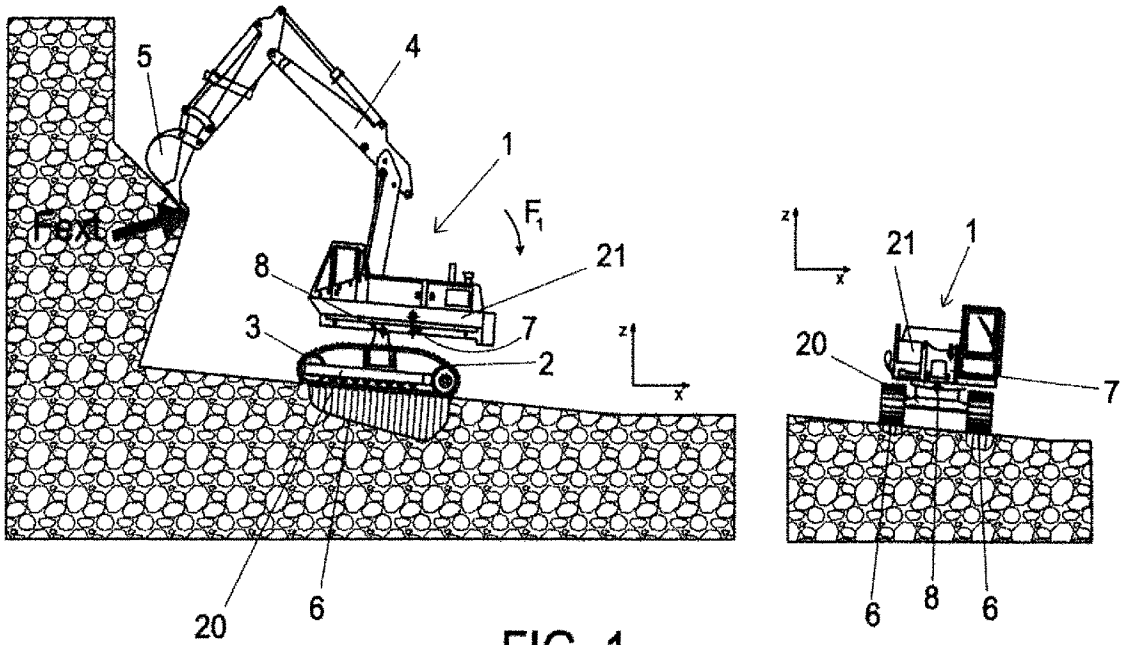
FIG. 1 includes a schematic elevational side view and a schematic elevational rear view illustrating by way of example and in operative conditions a backhoe machine of the type to which the system of the present invention can be applied.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

As has been mentioned above, the detailed description of a preferred embodiment of the system proposed by the present invention for controlling stability in heavy machinery of the type of that are moved with chains or treads, will be carried out below with the aid of the attached drawings, in which various operative and functional aspects of the system are shown. In this sense, by looking at the depiction shown in FIG. 1 of the drawings, it can be seen that the case of a backhoe-type machine 1 has been chosen for the illustrated example, although it must be clarified that the specific type of machine depicted is only an illustrative example and must be in no case interpreted as limiting the system of the invention.

As mentioned, the machine is moved by chains or treads applied on a travel unit on each side thereof, each travel unit being formed by a variable number of rollers and two end wheels, of which at least one end wheel 3 is driven from a motor incorporated in the structure of the machine, as is conventional.

Optionally, the machine can be of the type controlled by an onboard operator, or of the type controlled remotely. The elevational side view and elevational rear view shown in FIG. 1 of the drawings, show the machine in operative condition, such that the arm 4 is partially extended and the bucket 5 is applied on a portion of the ground, such as a rock wall or the like. As a result of the forces acting on the machine (schematically depicted as Fext), and of the actual weight of the elements forming same, stresses are transmitted to the ground surface on which the treads 2 are supported, thereby determining a force distribution area on each side of the machine which, for example, may correspond with that indicated by means of reference number 6 in FIG. 1 or another machine of similar nature. As can be seen, the result of applying stress by means of the bucket 5 leads to greater concentration of the reaction forces in the rear portion of the support area 6 of the machine, due to the moment generated in the direction of arrow F1. The center of gravity (G) will change depending on the geometry adopted by the machine as a whole, and in the case that is being considered, it may be, for example, in the position of arrow 7. The rotating shaft between the turret 21 and the carriage 20 is in the position shown with reference number 8.

In such operative conditions, the system of the present invention is enabled for determining in real time the risks of rollover of the machine 1, as well as for knowing whether or not the risk of rollover is reversible. For evaluating the risk of rollover, the system of the present invention envisages the incorporation in the machine of means enabled for providing a response on the risk of rollover depending on the actual instantaneous support surface of the chains or treads 2 of the machine 1 on the ground on which it moves. The instantaneous calculation of the perimeter enclosing the support base and determination of the reaction value at the support points of the machine on the ground, is carried out by means of the information obtained based on the values measured through detector elements incorporated at predetermined points of the carriage 20 of the machine 1, depending on the nature and on the actual structural characteristics of the machine. These detector elements can consist of sensors of various types, such as load cells, strain gages, etc.

According to the research and tests conducted by the present inventors, it has been determined that the most suitable elements for generating parameters that allow carrying out real rollover evaluation, can be a number of strain gages arranged integral with positions of the structure of the carriage 20 of the machine 1 advantageously protected from external agents, but corresponding with structural portions that are subjected to stresses such that they generate a type of deformation as a result of the stresses to which they are subjected, particularly those structural positions which, depending on the type of machine to which the system of the invention is applied, prove to be most sensitive to the stresses supported thereon, or they may consist of load cell-type sensors or the like advantageously coupled in predetermined positions of the supports 23 supporting the actual rollers on which the chains or treads 2 extend, in order to detect the values of the point loads that are being transmitted to the ground, as well as to detect which are the rollers that do not support any load as they are not supported on the ground, and to subsequently determine the exact perimeter of the correct support base in each instant.

As is known, strain gages are sensor devices that adhere to a surface, detect deformation level by means of a proportional variation of their electrical resistance which gives rise to voltage drops indicative of the resistance variation level and therefore of the magnitude of the deformation caused by it, whereas load cells provide electric signals of variable magnitude providing information about the load level (pressure) to which they are subjected.

Given that the control means used in the system are preferably located in the turret 21 of the machine, and that the detector elements 9 must have connections for powering same and also for collecting signals generated by same, the system of the invention has envisaged that the rotating joint associated with the shaft 8 consists of an electrified joint which subsequently allows transmitting signals through same. Consequently, no limitation whatsoever is imposed on the mutual rotation capacity between the carriage and the turret 21, allowing unlimited rotation of the carriage with respect to the turret without thereby being detrimental to the transmission of said signals.

In this point of the description it must be clarified that use of a electrified joint for the dual purpose of, on one hand, transmitting the signals generated by the detector elements 9 to the control members located in the turret 21 of the machine and, on the other hand, powering said detectors 9, is only a preferred embodiment that must not be understood as limiting. The system can mount on the machine any conventional means enabled for achieving this dual functionality, and it is very particularly envisaged that the system can make use of known wireless devices, such as for example, devices using RFID technology or other devices specifically developed for this application. Taking into account the foregoing, the system includes means which, taking into consideration the values of the signals generated by the various detector devices, allow determining in real time the perimeter of the real support surface of the machine on the ground and the reaction value on the ground (stresses measured in carriage 20 of the machine). The starting point of the conducted analysis is the values measured by the detectors included in the machine corresponding with the support areas on the ground, for which the system analyzes actual supports with compensation for factors such as ground hardness, morphology, the presence of foreign objects, etc.

FIGS. 3.1 and 3.2 depict an example of a machine 1 incorporating a plurality of detectors 9 which, as mentioned above, can preferably consist, although not in an excluding manner, of strain gages 9*b* or load cells 9*a*, where appropriate. The detectors are distributed through the structure of the carriage 20 of the machine 1, particularly in the areas thereof that are more sensitive to deformations resulting from the support areas of the machine on the ground. In FIG. 2 it is assumed that the machine is in a operative state performing work on a ground indicated with reference number 22, in which a portion of the machine is arranged in cantilevered manner protruding beyond an edge 22*a* constituting the limit of the support base with respect to which the moment of rollover indicated as Mv4 is generated; all the detectors 9 are supporting loads, whereas the detectors occupying positions 9.1 are without load, and it is therefore understood that the chains or treads 2 of the machine 1 lack support in that segment. As a result, the support perimeter of the machine corresponds with a closed enclosure which has been indicated with reference number 10, and which has been shown by way of a trapezoidal space only for explanation purposes, but which can understandably adopt any variable shape when implementing the works performed by the machine 1.

After the estimation of the enclosure 10, the means for analyzing the risk of rollover included in the system of the invention are enabled for determining the value of the moments of rollover with respect to each of the sides of the polygon demarcating the work enclosure. The graphical identification of these moments has been depicted in FIG. 2.2 by means of references Mv1, Mv2, Mv3 and Mv4, each of them associated with a respective side of the polygon. The combination of both factors, namely, the sides demarcating the enclosure 10 and the values of the moments of rollover Mv1, Mv2, Mv3 and Mv4 calculated in relation to each of the sides of this safety enclosure determined by the actual support surface of the machine, will allow making an effective real time calculation of the risks of rollover.

By way of example applicable to the specific type of machine 1 that is being considered throughout the present description, i.e., a backhoe-type machine, a possible distribution of the sensor devices 9 responsible for generating electric signals that will allow the calculating means to precisely determine the instantaneous configuration of the actual support enclosure 10 of the machine on the ground surface has been envisaged. A preferred way of application is graphically shown in FIGS. 3.1 and 3.2 of the drawings. Therefore, by first considering FIG. 3.1, the depiction of a support 23 for any one of the rollers on which the chain 2 of the machine is supported is seen, the roller support 23 of which is directly linked to a crosspiece 24 of the structure of the machine. The sensor 9*a*, preferably a sensor formed by a load cell, is incorporated between the physical support part 23 of the roller and the crosspiece 24 itself, such that any stress to which the respective roller is subjected must be transmitted to the structure of the machine necessarily through said sensor. This arrangement is applicable to all the rollers supporting the chain 2 on both sides of the machine, whereby each of the sensors 9*a* is enabled to generate the corresponding signal only when they are subjected to stress, the calculating means therefore detecting which are the actual supports and therefore what is the shape of the perimeter of the actual support base in each instant.

In turn, FIG. 3.2 illustrates a schematic depiction corresponding to the case in which the sensors used for determining the perimeter of the actual instantaneous support base of the machine are strain gages 9*b* applied in a plurality of previously selected positions of the support beams of the machine. In this case, an example of support beam 25 is depicted for supporting any of the sides of the chassis of the machine with which there is associated a number of supports 23 of support rollers of the moving chain, said support beam 25 having a plurality of sensors 9*b* distributed along its length, the sensors 9*b* consisting of strain gages in this case. This arrangement is particularly suitable for determining the actual perimeter of the support enclosure of the machine given that, since the support beam 25 is that which receives stresses from each and every one of the supports 23, it will tend to deform depending on the distribution of the reactions on the ground. The sensors 9*b* (strain gages) will therefore provide signals of variable amplitude depending on the deformation to which each of them is subjected, and based on the received signals, they will be able to measure the actual value of the reactions at the support points of the machine, and calculate how the actual support enclosure of the machine in each instant is.

Figure 4:
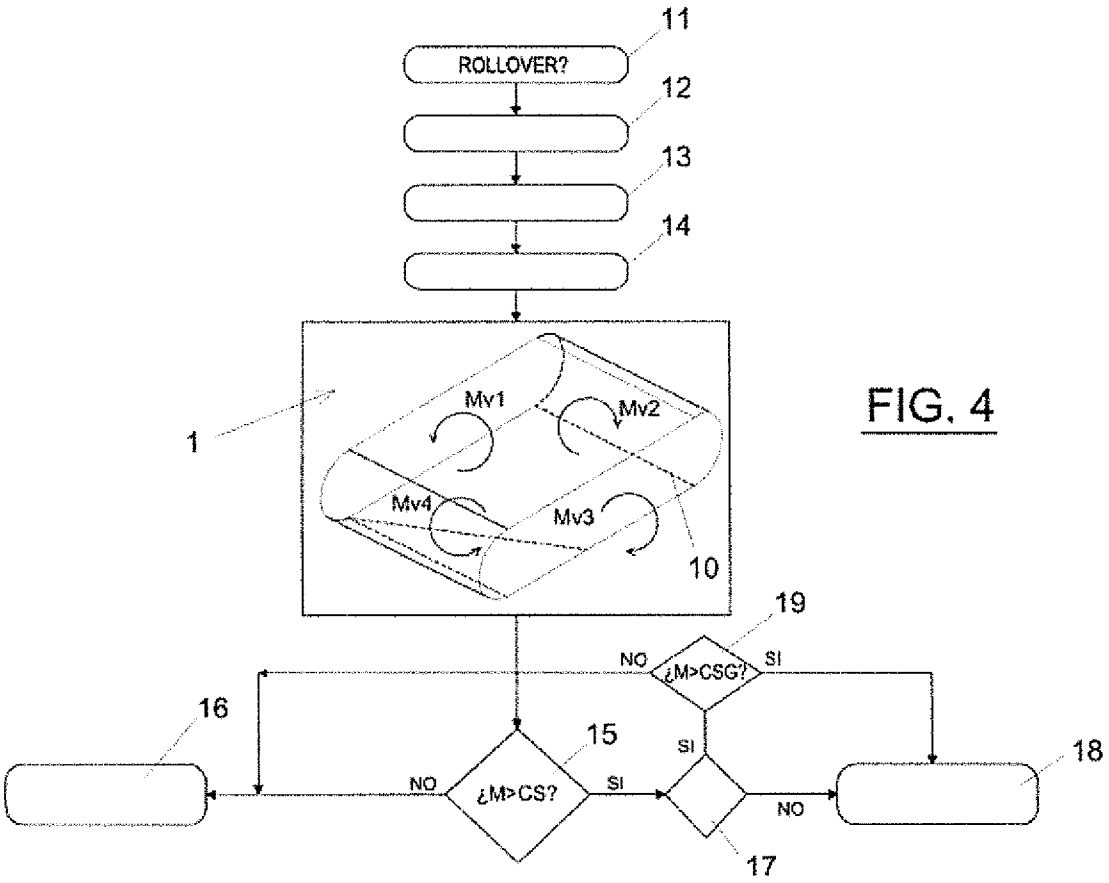
FIG. 4 is a flow diagram illustrating the various steps of a calculation process run for determining the stable balance conditions and reversible rollover conditions of the machine during use.
Figure 5:
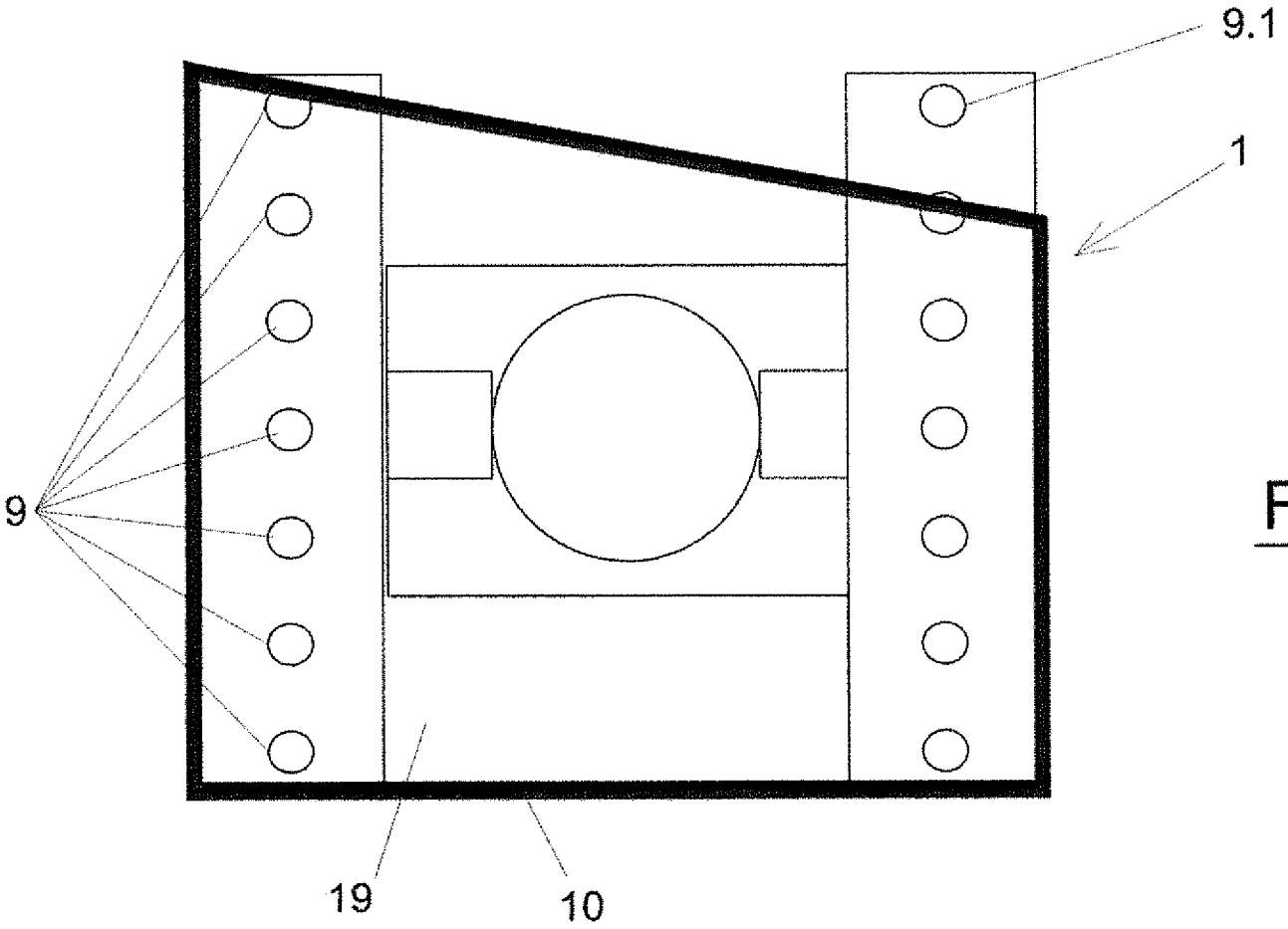
FIG. 5 is a graphical depiction illustrating the determination of the instantaneous support perimeter of the machine.

To evaluate the risk of rollover, the system has envisaged the implementation of means enabled for running a specific calculation algorithm taking into account the successive changes of the support surface, the reactions of the ground as a result of the forces acting on the machine, the actual weight thereof and the stable balance situations of the machine. This algorithm is depicted in FIG. 4 of the drawings, showing the depiction of a machine 1 of the mentioned type, a closed enclosure 10 illustrated by way of example as a support surface (or a support base) of the machine, and the moments of rollover Mv1, Mv2, Mv3 and Mv4 associated with each of the respective sides of said closed polygon forming the enclosure 10.

The calculation algorithm step 11 constitutes the start of the process and contains the term "rollover?" as a generic expression whereby the objective sought is to determine the level of the risk of actual rollover of the machine 1 during normal operation.

Based on this initial question, the value of the loads in the supports of the machine is read in step 12. Then, the actual geometry of the support perimeter, i.e., the contour 10 of the surface which is actually supporting the machine 1, is determined in step 13.

Next, based on the value of the loads measured in the supports of the machine 1, the value of the moments of rollover around each of the sides of the polygon 10 demarcating the support enclosure forming the support base of the machine is calculated in step 14. The value of the resulting moment M (Mv1, Mv2, Mv3, Mv4) obtained as a result of the evaluation performed in the preceding step is compared with a pre-established coefficient of safety CS in step 15 in order to determine whether or not the magnitude of the moment of rollover is greater than this coefficient of safety (which will be explained below in the present description). If the resulting moment is less than the coefficient of safety CS, it is determined in step 16 that there is no imminent risk of rollover.

If, in contrast, the result of the comparison performed in step 15 is positive, i.e., the value of the resulting moment M (Mv1, Mv2, Mv3, Mv4) is greater than said coefficient of safety CS, it is examined in step 17 if the moment corresponds to the opposite side of the bucket of the machine in order to determine whether or not the machine is in a reversible condition. If the result is positive, the algorithm proceeds to step 19 of analyzing the actual risk of rollover, whereas if the result is negative, alarms associated with the risk of rollover are generated in step 18.

The reversibility condition referred to in step 17 occurs when a machine 1 (the specific case of a backhoe machine still being considered) moves into a working position (see the operative sequence established by means of FIGS. 6.1 to 6.4) and arranges the arm 4 in a position such that the bucket 5 associated with the distal end of said arm can be applied on an area of the ground T to be dug (FIG. 6.1). Then, when it drives the bucket 5 into the ground T, the reaction associated with the stress made can cause the machine 1 to be lifted from the ground, at least partially around the side furthest from the perimeter 10 in relation to the part of the machine opposite the working position of the bucket 5, an angle $\alpha$ of variable magnitude (FIG. 6.2), due to swiveling support with respect to said opposite side. In these conditions, the moment of rollover around the edge of support of the machine opposite the edge of application of the bucket 5 will be greater than said pre-established coefficient of safety, which could be interpreted as an actual rollover situation. However, this situation does not correspond with an actual risk of rollover, the tilt ($\alpha$=0) disappearing and the machine being again supported on the ground surface T (FIG. 6.4) when the bucket 5 is raised. In such conditions, no incorrect and undesirable warnings or alarms are produced since it is a reversibility situation recognized by the calculation algorithm run by the means included for such purpose in the car or another place of the structure of the machine.

To analyze the reversible rollover identified in FIGS. 6.1, 6.2, 6.3 and 6.4 of the drawings, a method for determining the actual risk of rollover and eliminating false alarms based on the instantaneous analysis of the moment of rollover caused by the gravitational forces acting on the system has been developed, the theoretical bases of which will be explained in relation to FIGS. 6.3 and 7 of the attached drawings.

As explained in relation to the position of the machine shown in FIG. 6.2, i.e., partially lifted from the ground at specific angle due to the reaction derived from the application of the bucket 5 on the ground, the machine could interpret imminent risk of rollover and trigger the corresponding alarms.

Figure 7:
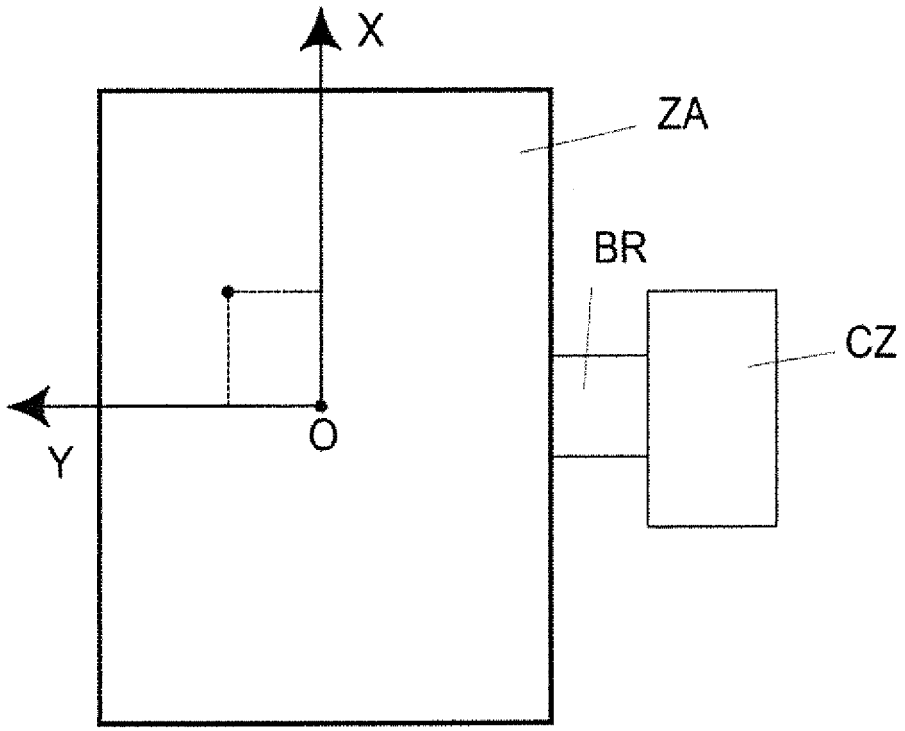
FIG. 7 is a diagram illustrating conditions in which unwanted alarms are generated due to reversible rollover situations in order to recognize and eliminate the same.

However, it is desirable to solve that type of situations in order to prevent the system from generating a plurality of false alarms which in addition to being completely unnecessary, are also generating noises and discomfort for operators. Therefore, to solve this type of situations a method has been developed based on the instantaneous analysis of the value of the moment (Mg) caused by the gravitational forces around the side of the support polygon 10 furthest from the bucket 5. To effectively determine the risk of reversible rollover, the depiction of FIG. 7 is considered, in which a machine of the type mentioned throughout the present description is supported in a support area ZA and has a bucket CZ extended in a working position on the right side of FIG. 7, so the risk of rollover is generated with respect to the edge L of the support area ZA opposite the extension of the arm BR and of the bucket CZ. To determine the risk of rollover, a method operating in the following manner is implemented:

1. Calculating the level of the risk of rollover according to the conventional method explained in the present description;

2. If the index of the risk of rollover at the edge (L) of the side contrary to the one of extension of the arm BR does not exceed a minimum value at which the alarm is activated, the system operates normally;

3. If, in contrast, it is determined in step 17 that the risk of rollover with respect to the edge (L) opposite the edge of extension of the arm BR exceeds a minimum value for alarm activation, the index of the risk of rollover is calculated based on the value calculated for the moment caused by the gravitational forces (Mg) acting on the system around the edge (L). Comparison is made in step 19 to determine whether or not the moment Mg is greater than a coefficient of safety CSG, if the result is negative, the non-existence of the imminent risk of rollover and the situation being a reversible rollover situation are determined in step 16. If, in contrast, the result of the comparison performed in step 19 is positive, i.e., the value of the moment of Mg is greater than said coefficient of safety CSG, the existence of the risk of rollover is determined in step 18.

It is not considered necessary to further describe the content of the present description so that any person skilled in the art can comprehend the scope thereof and put the system constituting the described object into practice. Nevertheless, it must be understood that the described embodiment is only a preferred, non-limiting embodiment of the invention, and that it can therefore be susceptible to changes and modifications both as regards structural aspects and as regards functional aspects, provided that these changes are comprised within the scope of the following claims.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

The invention claimed is:

1. A system for stabilizing heavy machinery, particularly a system enabled for being implemented in a machine (1) of the backhoe type moved by chains or treads (2), intended for determining the stability of the machine by means of evaluating the risk of rollover associated with the different positions adopted by the machine during various phases of work, the system comprising:

a carriage (20), a turret (21) linked to the carriage (20) by means of a rotating shaft (8) and provided with an extendable arm (4) bearing at its free end a work tool such as a bucket (5), wherein said system includes: a plurality of detector elements (9) responsible for generating and providing electric signals intended for the real time determination of a support base of the machine enclosed by a perimeter (10) and measuring a reaction value at the support points of the machine in each instant; means for transmitting the electric signals generated by the various detector elements (9) to the operative members of the turret (21), the rotating shaft (8) having for such purpose an electrified joint allowing both functions of powering the detector elements (9) and of transmitting the signals generated by them to control means; means for evaluating and controlling the signals generated by the mentioned detectors (9) for determining based on the received signals, the perimeter of the support base, and for evaluating the moments of rollover (Mv1, Mv2, Mv3, Mv4) with respect to each of the sides of the enclosure demarcated by said perimeter (10); and means for evaluating the position of a center of gravity (G) of the machine (1) with respect to the perimeter (10);

means to execute a specific algorithm for determining the risk of rollover comprising the following steps:

measuring (12) in real time the value of the stresses in the supports of the machine by means of the detectors (9) subjected to load;

determining (13) the perimeter (10) of the support enclosure based on the values measured in step (12);

calculating (14) the value of the moments of rollover M (Mv1, Mv2, Mv3, Mv4) based on the values measured in the preceding step (12) and of the perimeter determined in the preceding step (13);

comparing (15) the moment M (Mv1, Mv2, Mv3, Mv4) calculated in the step of calculating (14), with a predefined coefficient of safety (CS) in order to determine if the moment M (Mv1, Mv2, Mv3, Mv4) is greater or less than said coefficient of safety (CS);

if the result of the comparison in the preceding step is less than the value of the coefficient of safety (CS), determining (15) that there is no risk of rollover;

if, in contrast, the result of the comparison (15) is a value greater than that of said coefficient of safety (CS), determining in step (17) if the moment M (Mv1, Mv2, Mv3 or Mv4) exceeding the value of the said coefficient of safety (CS) is that calculated with respect to the edge (L) of the support area ZA opposite the extension of the arm (BR) and of the bucket (CZ);

if the result of step (17) is negative, determining that there is an actual imminent risk of rollover and generating (18) the relevant alarms; if the result of the step (17) is positive, calculating in step (19) based on gravitational forces the moment Mg and comparing with a predefined coefficient of safety (CSG) in order to determine if the moment Mg is greater or less than said coefficient of safety; and if the result of step (19) is a value less than (CSG), communicating said value to step (16) for determining the absence of imminent risk of rollover; if, in contrast, the result of step (19) is a value greater than (CSG), determining that there is an actual imminent risk of rollover and generating (18) the relevant alarms.

2. The system according to claim 1, further comprising:

at least one sensor responsible for generating signals for determining the perimeter (10) with respect to which the moments of rollover are calculated essentially consist of one of load cells and strain gages (9*b*) distributed throughout stress- and deformation-sensitive areas of the machine (1) such as between the supports (23) of each of the rollers supporting the moving chains (2) of the machine and the crosspiece (24) of the support beam in the case of load cells (9*a*), and in positions distributed along the crosspieces (25) in which the mentioned supports (23) of the rollers of each side of the machine (1) are located in the case of strain gages (9*b*).

3. The system according to claim 1, wherein:

the means for transferring signals between the detector elements (9) and the control members located in the turret (21) and/or the means for powering said detector elements, can alternatively be implemented by wireless devices.

4. The system according to claim 1, wherein:

the perimeter (10) demarcating the actual support base of the machine (1) is established taking into consideration only the signals generated by the detectors (9) which are subjected to an actual load at that moment, and the detectors (9.1) that are not subjected to an actual load at that moment being rejected.

* * * * *